United States Patent [19]

Flath

[11] 4,219,952

[45] Sep. 2, 1980

[54] INFORMATION CARRIER

[76] Inventor: Wolfgang Flath, Viktoria Strasse 3, 8 Munchen 40, Fed. Rep. of Germany

[21] Appl. No.: 922,721

[22] Filed: Jul. 7, 1978

[30] Foreign Application Priority Data

Jul. 7, 1977 [DE] Fed. Rep. of Germany ... 7721380[U]

[51] Int. Cl.[2] ..... G09F 7/10

[52] U.S. Cl. ..... 40/622; 40/611

[58] Field of Search ..... 40/618, 611, 620, 622, 40/585, 605; 35/7 A, 24 A, 31 F; 248/220.1, 221.1, 223.1

[56] References Cited

U.S. PATENT DOCUMENTS

| | | | |
|---|---|---|---|
| 1,258,146 | 3/1918 | Russell | 40/618 |
| 2,541,460 | 2/1951 | Bugh | 40/618 |
| 2,682,125 | 6/1954 | Coffield | 40/618 |
| 3,943,646 | 3/1976 | Branham | 40/605 |

FOREIGN PATENT DOCUMENTS

| | | | |
|---|---|---|---|
| 548533 | 8/1930 | Fed. Rep. of Germany | 40/618 |
| 1090948 | 10/1960 | Fed. Rep. of Germany | 40/611 |
| 7412555 | 4/1974 | Fed. Rep. of Germany . | |
| 2448964 | 4/1975 | Fed. Rep. of Germany . | |
| 1524925 | 5/1968 | France | 35/24 A |
| 215871 | 5/1924 | United Kingdom | 40/618 |

*Primary Examiner*—John F. Pitrelli
*Assistant Examiner*—G. Lee Skillington
*Attorney, Agent, or Firm*—Armstrong, Nikaido, Marmelstein & Kubovcik

[57] ABSTRACT

An information carrier is disclosed which comprises a base plate which supports a plurality of blocks. The base plate includes at least one guide rail. The blocks include an information bearing face portion and a guide strip. The guide strip is adapted to be slidably and matingly received by the guide rail, thereby mounting the blocks on the base plate. A first groove is located in the base portion adjacent one lateral edge and extending perpendicular to the guide rail. A second groove is located in at least one of the blocks. A locking element is provided which is adapted for insertion through the first and second grooves for preventing lateral movement of the blocks in at least one direction.

22 Claims, 12 Drawing Figures

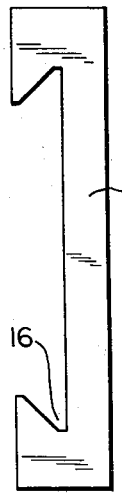
FIG. 5a
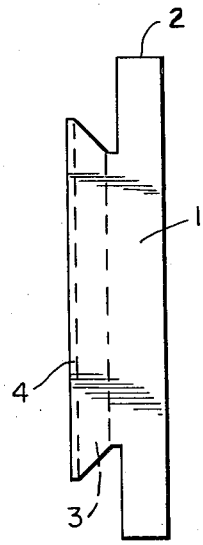
FIG. 5b
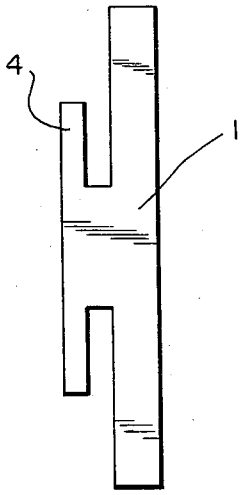
FIG. 5c
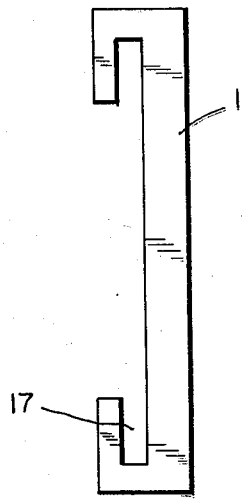
FIG. 5d
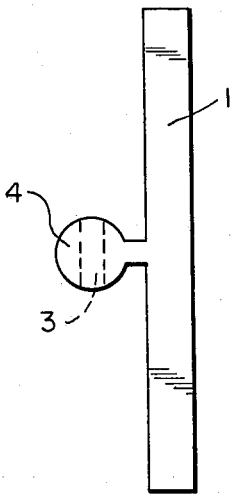
FIG. 5e
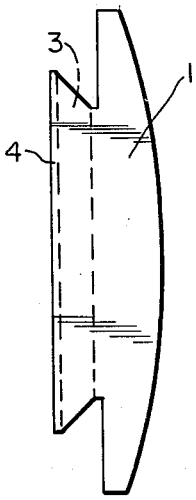
FIG. 5f
FIG. 5

INFORMATION CARRIER

BACKGROUND OF THE INVENTION

1. Field of the Invention

The invention relates to an information carrier, and more particularly to a signboard having character parts which are matingly slipped onto cooperating guide rails of a base plate, the character parts being provided on the surface, as needed with letters, numerals or symbols.

2. Description of the Prior Art

A tabular information carrier is known and described in German Utility Model No. DE 7 412 555, consisting of a base plate into which horizontal, parallel grooves are milled and into which may be slided letters or numerals which have spherical mounting elements on their back. This system has the drawback that the spherical mounting elements on the back of the letters can easily break off or that the thin-wall letters or numerals break into pieces when handled carelessly. Moreover, in this type of information plate there is a risk that the open grooves of the base plate get soiled when used over a fairly long period of time, so that it is hardly possible to use the information carrier on outer walls or as street signs.

An advertising sign is known and described in German Unexamined Application No. DE 2 448 964, into which removable letter blocks are inserted. The advertising sign includes a bottom plate onto which profile strips are inserted. The profile strips have trapezoidal tracks into which the letter parts are inserted. The rows of letters are held in position at the sides by an L-shaped profile strip which, after the rows of letters have been put together, is screwed together with the bottom plate. The lateral locking of the rows of letters by a screwable side strip is cumbersome and expensive, since the side strip constitutes an additional costly component. The letters can only be replaced with tools. In addition, the decorative appearance of the information carrier is affected by the mounting bolts for the side securing strips, which can be seen from the outside.

SUMMARY OF THE INVENTION

It is an object of the invention to provide an information carrier wherein the designation blocks are easily replaceable.

Another object of the invention is to provide an information carrier wherein the blocks can be put together to form rows of blocks.

Still another object is to provide an information carrier utilizing designation blocks which can be locked in position by a mechanism that is easy to operate.

A further object of the invention is to provide an information carrier and designation block assembly wherein the decorative appearance of the information carrier is not impaired by visible mounting devices or screws.

The problem according to the invention is solved by providing an information carrier comprised of blocks having a face portion and a guide strip. The face portion has a square periphery and straight lateral edges. The guide strip, located on the rear surface of the face portion, provides an interlocking mating portion wherein the guide strip can be fitted into an appropriately designed guide rail of the base plate. Cooperating grooves are provided in the base plate and in selected blocks for locking the blocks in position on at least one perpendicular lateral edge of the information carrier at right angles to the guide rails. A locking or blocking pin being provided and adapted for insertion into said grooves.

The information carriers embodying the principles of the invention are suitable for use as door signs, road signs, markings inside and outside of buildings and as nameplates. These information carriers have the advantage that they require no coverings for holding the letters. The designation blocks preferably consist of weatherproof material, e.g. from plastic or metal.

The blocks may be put together to form individual rows of blocks, or alternately, it is also possible to slip an undivided row of blocks onto a guide rail and lock them in position at the side.

Preferably, the individual blocks consist of standard sizes having the same height. They may have varying widths, which will depend on the marking applied to the surface of the block. Thus, for wide letters, it is preferable to use broader character blocks than for narrow letters. A usual measure for the width of the designation block is, for example, 4, 6, 8, 10, or 12 mm. The width of the designation blocks, may, however, also be any multiple of the width.

The markings may be painted, impressed, milled or punched into the surface of the blocks.

The designation blocks may likewise consist of a plate which fully covers a portion of the base plate. In this case, too, the cover plate is preferably connected with the base plate over a guide strip. The cover plate which, for example, may be made in a color which is different from that of the letters or of the designation blocks, has a groove at its side through which the locking pin is guided. This is to ensure that the cover plate and the designation blocks which are arranged therebelow or thereabove have a uniform finished shape.

The guide strips placed on the bottom of the blocks may have, for example, a dovetailed, T-shaped or tubular configuration. The base plate is provided with an appropriately designed cooperating mating recess, so that the blocks can be slid and form-fitted into the guide strip in question. However, the mounting between the blocks and the base plate may also be inverted, that is to say, the guide strip in the blocks may consist of an appropriately shaped recess. In this case, the recess in the blocks would have, for example, a dovetailed, T-shaped or tubular configuration.

The surface of the top side of the blocks is preferably either flat or convex.

The information carrier system in accordance with the invention is quite variable and versatile. For example, an unmarked block may first be placed on the guide rail of the base plate, then the corresponding letter blocks are slipped on in succession, e.g., while the desired name is being composed. The distances between the single letter blocks can be chosen freely by inserting unmarked blocks. The closure again may be effected, e.g., with unmarked blocks, a block being chosen as closing block into which a groove is cut for the lateral locking. The groove in the outer blocks will have the same distance from the side edge as the groove in the edge of the base plate. In this way, the insertion of the locking pin into the continuous groove is assured without difficulty. The locking pin may be sunk completely in the groove so that after locking the pin is no longer visible from the outside. At the upper end, the locking pin preferably has a thickened or bent-over end situated in a corresponding recess of the groove. In this way, the pin is prevented from slipping downwardly. However, the locking pin may also have a screw thread at the bottom and/or upper end. In this case, either the top or bottom outer blocks may be provided with cooperating threads.

The continuous groove, which is preferably provided on one side only of the information carrier, has a depth which is substantially the same as the height of the guide rail of the base plate or of the guide strip of the outer blocks.

BRIEF DESCRIPTION OF THE DRAWINGS

The information carrier in accordance with the invention will now be described with reference to the accompanying drawings, wherein:

FIGS. 5*a*–5*f* are side elevation views of some illustrative embodiments of the blocks.

DETAILED DESCRIPTION OF THE PREFERRED EMBODIMENTS

Figure 1:
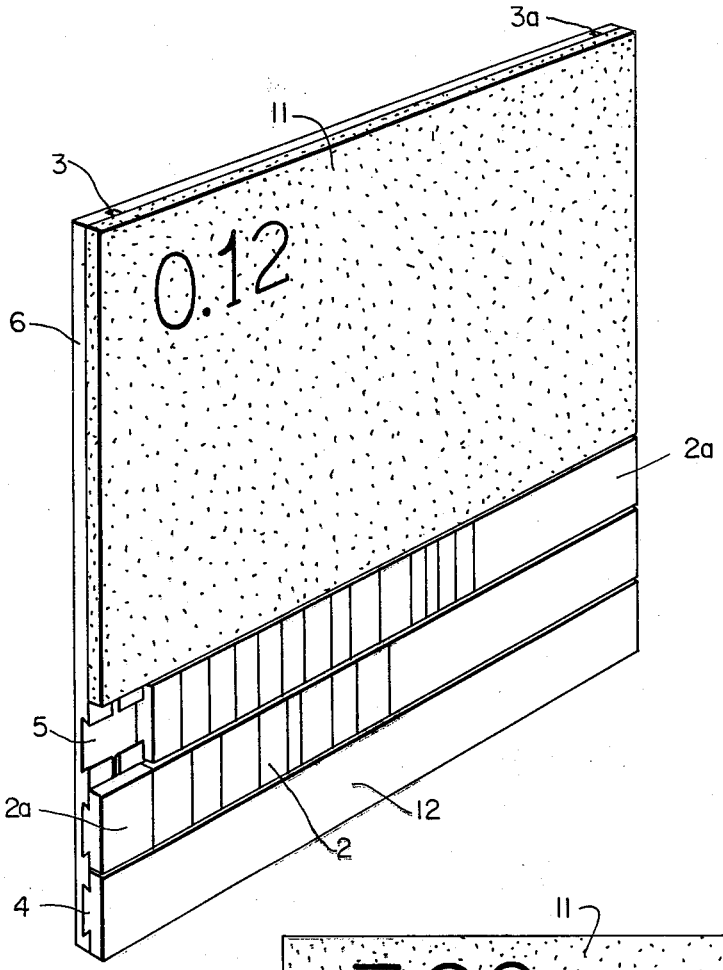
FIG. 1 is a first elevation view of an information carrier according to the invention.

FIG. 1 shows an information carrier comprising a base plate 6 into which dovetailed guide rails 5 have been milled. On the top part of the base plate 6 there is attached a cover plate 11 serving as a designation plate. The plate 11 preferably has a color which is different from that of blocks 2. Blocks 2, which are comprised of a top part 1 and a guide strip 4, are slid into guide rails 5. The outer designation blocks are labeled 2*a*. The bottom termination of the information carrier may be formed by an undivided block 12.

Figure 2:
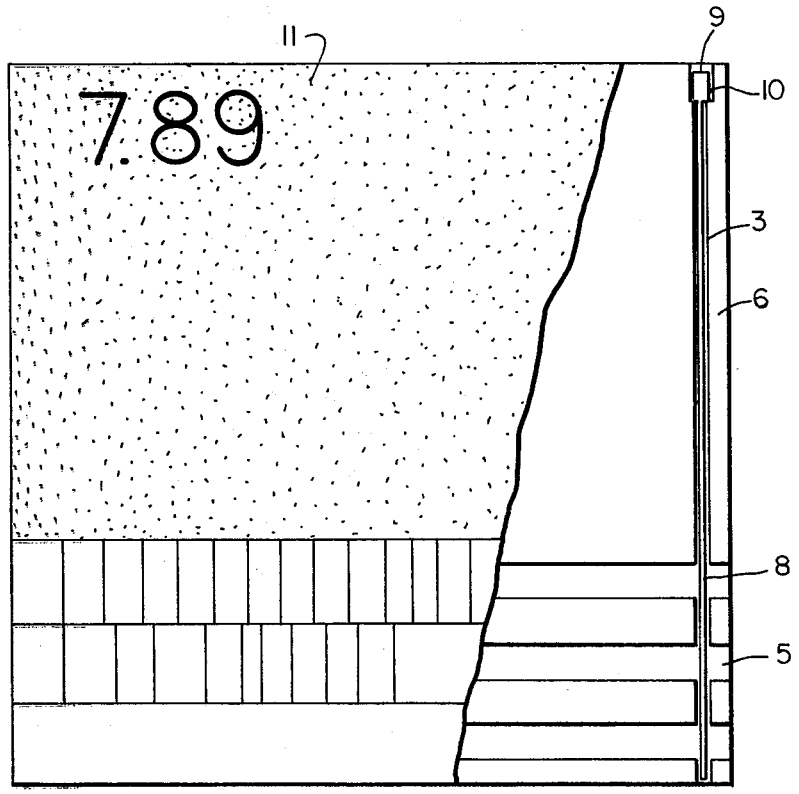
FIG. 2 is a front elevation view, partly in section, of the information carrier.

To lock the character blocks and the cover plate there are provided at right angles to guide rails 5, in the lateral edges of the information carrier, grooves 3 and 3*a* into which a locking pin 8 may be inserted. FIG. 2 shows the position of the locking pin 8 in groove 3. The locking pin 8 is provided with a head 9 dimensioned to be received in a recess 19 of groove 3. The grooves may be sawed or milled into the base plate and the guide strip of the side blocks or may be formed therein in any other way. Since locking pin 8 is concealed under the surface of outer blocks 2*a* and of cover plate 11, the outer appearance of the information carrier is not impaired by the closure. Preferably, as shown in FIG. 2, the locking pins are sunk completely in groove 3 or 3*a*. The head 9 formed on the end of backing pin 8 may be provided with the ends adapted to mate with a cooperating threaded surface, such as a nut, located in an extension of the groove. However, the locking pin may also be bent over at the upper end.

Figure 3:
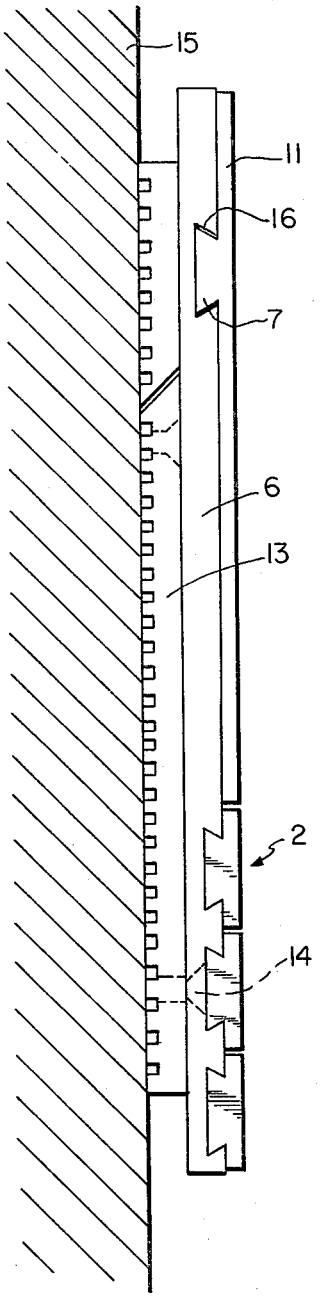
FIG. 3 is a side elevation view of an information carrier in accordance with the invention.

FIG. 3 is a side view of an information sign according to the invention which is in contact with the wall of a building over a compensating or mounting plate 13. Base plate 6 is connected to wall 15 over the mounting plate 13, using a screw 14 capable of being sunk. In this illustrative embodiment cover plate 11 has on the bottom a dovetailed guide strip 7 which is slid into an appropriate recess 16 in the base plate 6.

Figure 4:
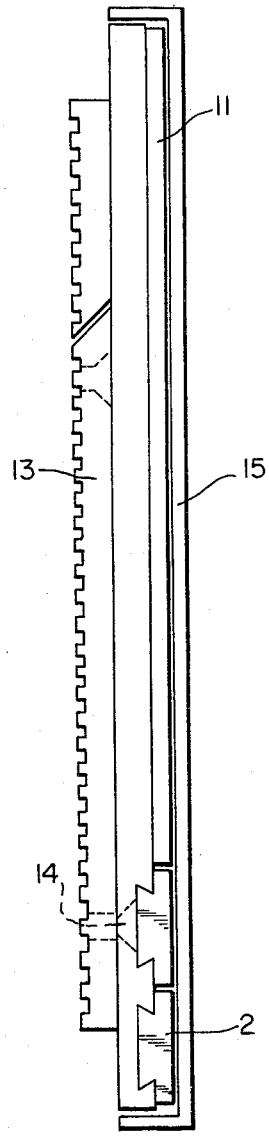
FIG. 4 is a side elevation view showing another illustrative embodiment of the information carrier.

FIG. 4 illustrates another embodiment of the information carrier according to the invention, wherein cover plate 11 and blocks 2 are enclosed with a transparent plate covering the entire information carrier.

FIGS. 5, 5*a*–5*f* show various forms of construction for the blocks 2. Face portions 1 of the blocks may be flat or, as shown in FIG. 5*f*, convex. All the blocks of FIGS. 5*a* to 5*f* have the same height. FIGS. 5*b* and 5*f* illustrate blocks having dovetailed guide strips; while FIG. 5*c* illustrates a T-shaped guide strip; and FIG. 5*e* illustrates a tubular guide strip. In the event the blocks are outer blocks, the guide strips 4 are provided with locking grooves 3, as shown in FIGS. 5*a* and 5*d*. The blocks may also be provided with dove-tailed or T-shaped recesses 16 or 17, as illustrated in FIGS. 5*a* and 5*d*.

Figure 6:
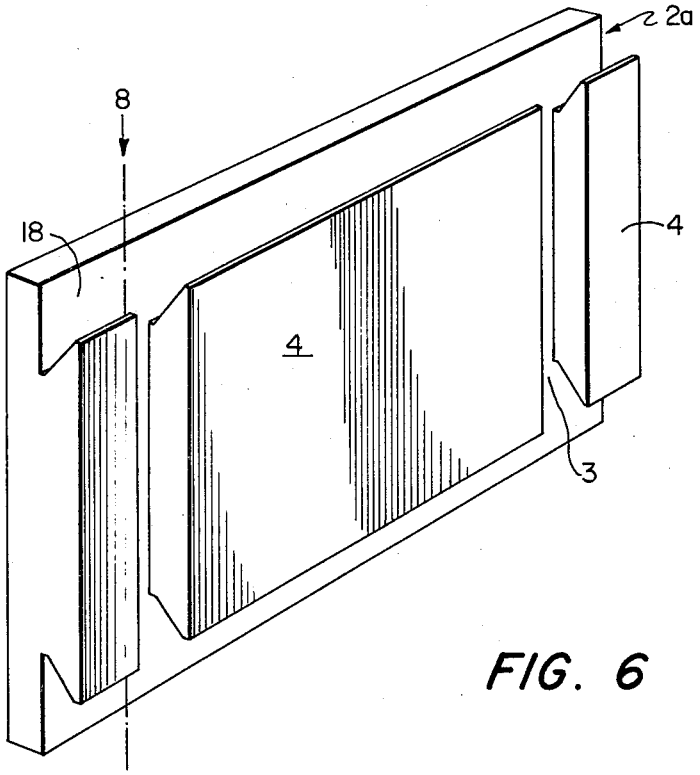
FIGS. 6 and 6*a* are rear perspective views showing the rear of an outer block.

FIG. 6 illustrates the bottom of an outer block 2*a*. On the rear surface 18 of the block is a guide strip 4 which is interrupted at a lateral edge, so that the outer block can be used as an outer block both on either the right or left side of the information carrier. For example, if the side block of FIG. 6 is on the left side of the information carrier, locking pin 8 is guided through the left groove only.

Figure 6A:
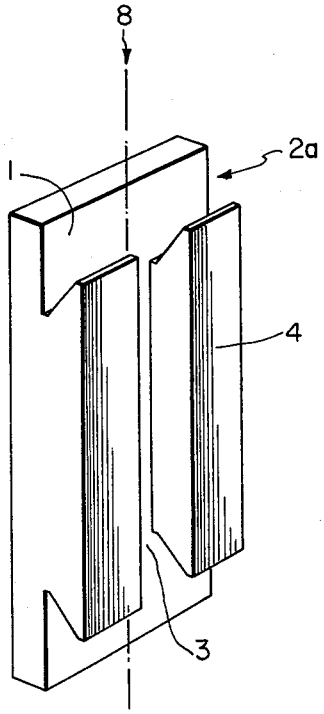

FIG. 6*a* is a plan view showing the rear of an outer block 2*a*. The guide strip 4 is provided with only one continuous groove 3 which is adapted to receive the locking pin 8. This block too, may be employed as a right or left outer block of the row of blocks. The outer block may, of course, also be utilized within the row of blocks.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. An information carrier comprising:

a base plate, said base plate including at least one guide rail:

a plurality of blocks having the same height, said blocks including an information bearing face portion on one side and a guide strip on the reverse side, wherein said guide strip is adapted to be slidably matingly received within said at least one guide rail thereby mounting said blocks on said base plate and the face portion of said blocks has a square periphery and straight lateral edges;

a first groove located in said base plate adjacent at least one lateral edge portion extending perpendicular to the guide rail and substantially throughout the entire length of said base plate adjacent said lateral edge to the guide rail;

a second groove located in at least one of said blocks;

a locking means adapted to be inserted through said first and second groove wherein said locking means is completely sunk into said first groove means and prevents lateral movement of said blocks in at least one direction.

2. An information carrier as claimed in claim 1, wherein said blocks are put together in rows of blocks, the outlying blocks each being fitted with said groove.

3. An information carrier as claimed in claims 1 or 2, characterized in that said blocks have standard dimensions, the individual blocks of a row having the same or different width.

4. An information carrier as claimed in claim 3, wherein said blocks have a width of 4, 6, 8, 10, 12 mm or a multiple thereof.

5. An information carrier as claimed in claim 1, wherein each said block consists of one piece and is as wide as said base plate.

6. An information carrier as claimed in claim 1, wherein said block consists of a cover plate which is as wide as said base plate.

7. An information carrier as claimed in claim 1, wherein said guide strip of said blocks is of a dovetailed configuration.

8. An information carrier as claimed in claim 1, wherein said guide strip of said blocks is of a T-shaped configuration.

9. An information carrier as claimed in claim 1, wherein said guide strip of said blocks is of a tubular configuration.

10. An information carrier as claimed in claim 1, wherein said guide strip of said blocks is of a dovetailed recess configuration.

11. An information carrier as claimed in claim 1, wherein, said guide strip of said blocks is of a T-shaped recess configuration.

12. An information carrier as claimed in claim 1, wherein said guide strip of said blocks is of a tubular recess configuration.

13. An information carrier as claimed in claim 1, wherein said face portion of said blocks is flat.

14. An information carrier as described in claim 1, wherein said blocks or the surfaces thereof are made of plastic.

15. An information carrier as described in claim 1, wherein said blocks of surfaces thereof are made of metal.

16. An information carrier as claimed in claim 1, wherein said locking means comprises a locking pin, said locking pin having a thickened or bent-over end situated in an extension of said first groove.

17. An information carrier as claimed in claim 1, wherein said locking means comprises a locking pin, said locking pin having a screw thread on a bottom and/or upper end.

18. An information carrier as claimed in claim 17, wherein said individual blocks on a bottom outer border have a thread into which said locking pin may be screwed.

19. An information carrier as claimed in claim 1, wherein said first groove has a depth substantially corresponding to that of said guide rail.

20. An information carrier as claimed in claim 1, wherein said first groove has a depth substantially corresponding to that of said guide strip.

21. An information carrier as claimed in claim 1, wherein said first groove extends into the edge of a cover plate.

22. An information carrier as claimed in claim 1, wherein said guide strip of the outer blocks is provided with two grooves at equal distances from the lateral edges of said block.

* * * * *